US005500723A

United States Patent [19]

Godlove

[11] Patent Number: 5,500,723

[45] **Date of Patent: *Mar. 19, 1996**

[54] METHOD AND APPARATUS EMPLOYING VARIABLE PRESSURE TO CLEAN A SUBSTRATE IN A PRINTING APPARATUS

[75] Inventor: Ronald E. Godlove, Bergen, N.Y.

[73] Assignee: Xerox Corporation, Stamford, Conn.

[ * ] Notice: The term of this patent shall not extend beyond the expiration date of Pat. No. 5,239,350.

[21] Appl. No.: 176,448

[22] Filed: Dec. 30, 1993

[51] Int. Cl.[6] ..... G03G 21/00

[52] U.S. Cl. ..... 355/296; 355/299

[58] Field of Search ..... 355/296, 299, 355/301

[56] References Cited

U.S. PATENT DOCUMENTS

| | | | |
|---|---|---|---|
| 4,465,362 | 8/1984 | Tohma et al. | 355/299 |
| 4,702,591 | 10/1987 | Tsuda et al. | 355/299 |
| 4,967,238 | 10/1990 | Bares et al. | 355/296 |
| 5,239,350 | 8/1993 | Godlove | 355/299 |

FOREIGN PATENT DOCUMENTS

| | | | |
|---|---|---|---|
| 58-87576 | 5/1983 | Japan | 355/299 |
| 59-204874 | 11/1984 | Japan | 355/299 |
| 61-141475 | 6/1986 | Japan | 355/299 |

*Primary Examiner*—Fred L. Braun
*Attorney, Agent, or Firm*—Finnegan, Henderson, Farabow, Garrett & Dunner

[57] ABSTRACT

An electrostatic printer employing a cleaning blade that applies a variable amount of pressure on a photoreceptor substrate. The printer detects an amount of toner on the substrate, and varies the cleaning blade pressure as an increasing function of the detected amount of toner.

14 Claims, 6 Drawing Sheets

METHOD AND APPARATUS EMPLOYING VARIABLE PRESSURE TO CLEAN A SUBSTRATE IN A PRINTING APPARATUS

BACKGROUND OF THE INVENTION

1. Field of the Invention

The present invention relates to method and apparatus for cleaning a substrate in a printing apparatus, and, more particularly, to a method and apparatus for cleaning the substrate by applying variable pressure to the substrate.

2. Discussion of the Related Art

A typical document copier includes an electrostatic printer with a belt having a photoconductive surface. To transfer an image onto a sheet of paper, the printer charges the belt to a uniform potential, and subsequently exposes the belt to a pattern of light corresponding to the image. Parts of the belt exposed to the light are discharged, resulting in an electrostatic latent image being formed on the belt. The portion of the belt having the electrostatic image then passes a development station that deposits toner on the belt in the pattern of the image, resulting in a toner powder image being formed on the belt. A piece of paper is then tacked to the belt and then removed from the belt, resulting in an image being formed on the paper.

In a printing process of this type, some residual toner particles will remain on the photoconductive surface after the toner image has been transferred to the paper. In addition to the residual toner, other residual particles, such as paper debris, additives and plastic, are left behind on the surface after image transfer. The residual particles should be mostly removed prior to the next printing cycle to avoid their interference with production of another image.

Various methods may be used for removing residual particles, such as methods employing a cleaning brush, a cleaning web, or a cleaning blade of a rubber-like material such as polyurethane. Blade cleaning scrapes or wipes across the belt to remove the residual particles from the belt. Blade cleaning is a desirable method for removing residual particles due to its simplicity and economy. Blade cleaning entails frictional contact with the belt, however, which degrades the blade over a period of time.

A conventional blade cleaning method applies a constant blade pressure against the substrate. The constant pressure is chosen based on the many contingencies that might affect cleaning performance. The resulting constant pressure is more than is needed under some conditions, thereby accelerating the wear rate of the blade. If an over-pressured blade is configured in "doctor mode," the blade will be more susceptible to fold-under, resulting in immediate destruction of the blade and perhaps even damage to the belt. More particularly, lesser amounts of residual toner to be cleaned results in increased friction and adhesion between the blade and the belt. The increase in the friction and adhesion cause the blade to be drawn further downstream in the process direction, with an increase, therefore, in the pressure of the blade against the belt. This increase in pressure initiates a positive feedback mechanism which increases the friction and adhesion, which increases the pressure, etc.

Thus, excessive frictional contact results from excessive pressure on the blade, leading to premature blade failure. Insufficient pressure on the blade, however, leads to insufficient cleaning of the substrate.

The following disclosures may be relevant to various aspects of the present invention and may be briefly summarized as follows:

U.S. Pat. No. 3,918,809 to Hwa discloses an apparatus for cleaning liquid developer from an upwardly moving support surface, such as a reusable surface for carrying latent electrostatic images. Cleaning blades clean the support surface. Separate members hold the cleaning blades in contact with the support surface.

U.S. Pat. No. 5,034,774 to Higginson et al. discloses an apparatus for applying toner for developing an electrostatic latent image formed on the charge retaining surface of a moving recording medium. The apparatus includes compliant cleaning blades for contacting a drying roller to prevent agglomeration of papers fibers and toner particles on the interface between the roller and the scraper blade.

OBJECTS AND SUMMARY OF THE INVENTION

It is an object of the invention to provide a printing apparatus having an improved substrate cleaning system.

It is another object of the present invention to provide a printing apparatus that regulates pressure applied to a cleaning member.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a method of operating an apparatus having a substrate and a cleaning member contacting the substrate, comprises the steps of moving the substrate relative to the cleaning member; detecting residual particles on the substrate; and causing the cleaning member to apply a variable pressure to the substrate, the variable pressure being an increasing function of an amount of residual particles detected by the detecting step.

According to another aspect of the present invention, a method of operating an apparatus having a substrate and a cleaning member contacting the substrate, comprises the steps of moving the substrate relative to the cleaning member; detecting residual particles at a location downstream from the cleaning member; and causing the cleaning member to apply a variable pressure to the substrate, the variable pressure being an increasing function of an amount of residual particles detected by the detecting step.

According to yet another aspect of the present invention, an apparatus comprises a substrate; a cleaning member configured to remove residual particles from the substrate; means for moving the substrate relative to the cleaning member; means for generating a signal indicating an amount of residual particles on the substrate; and means, responsive to the signal, for causing the cleaning member to apply a variable pressure to the substrate.

According to yet another aspect of the present invention, an apparatus comprises a substrate; a cleaning member configured to remove residual particles from the substrate; means for moving the substrate relative to the cleaning member; means for generating a signal indicating an amount of residual particles at a location downstream from the cleaning member; and means, responsive to the signal, for causing the cleaning member to apply a variable pressure to the substrate.

BRIEF DESCRIPTION OF THE DRAWINGS

The accompanying drawings, which are incorporated in and which constitute a part of this specification, illustrate one embodiment of the invention and, together with the description, explain the principles of the invention. In the drawings.

DESCRIPTION OF THE PREFERRED EMBODIMENTS

Figure 1:
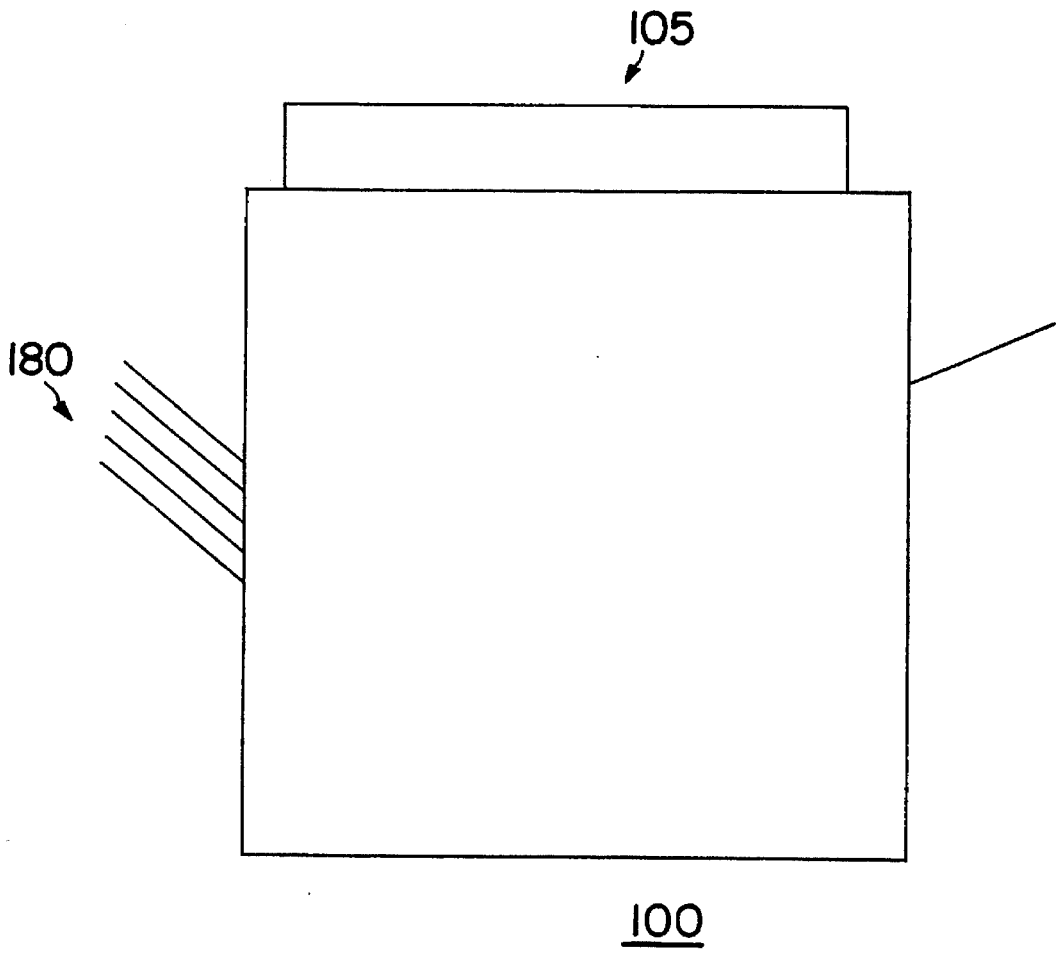
FIG. 1 is an external view of a copier according to the preferred embodiments of the present invention.

In FIG. 1 the exterior of a preferred copier 100, including an electrostatic printer, of the preferred embodiments of the present invention is shown to include a document feeder 105 for transporting an original document to a platen where the copier scans the original document. Copier 100 then duplicates the original document image onto a piece of paper and transports the piece of paper to paper output tray 180.

Figure 2:
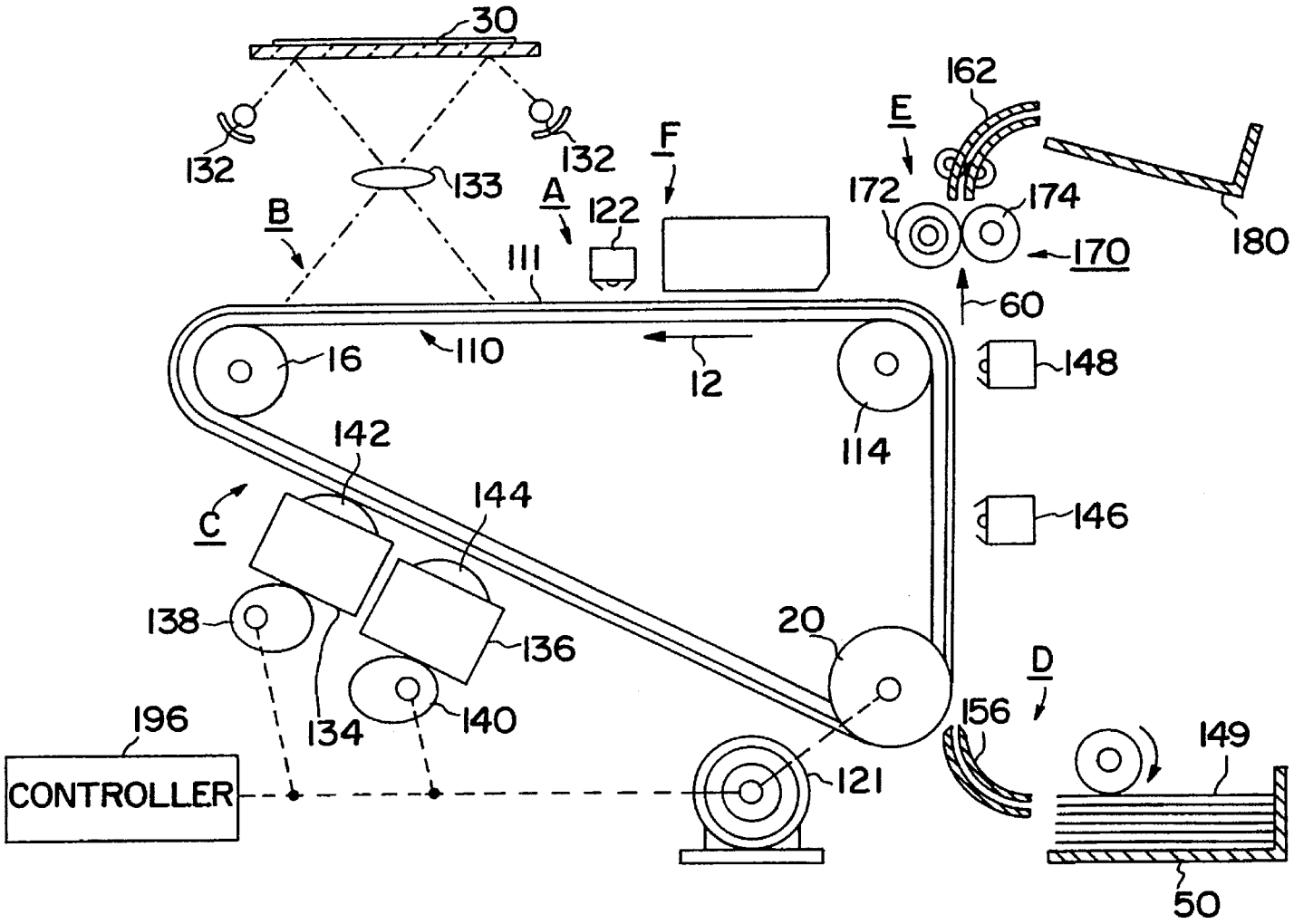
FIG. 2 is a schematic elevational view depicting various operating components of the copier shown in FIG. 1.

The interior of the copier 100, as shown in FIG. 2, includes a photoreceptor belt 110 has a photoconductive surface 111. Belt 110 moves in the direction of arrow 12 to advance successive portions of belt 110 through various processing stations sequentially disposed about the path of movement of belt 110. Belt 110 is entrained about a stripping roller 114, a tension roller 16, and a drive roller 20 driven by a motor 121. A pair of springs (not shown) maintain belt 110 in tension by resiliently urging tension roller 16 against belt 110. Both stripping roller 114 and tension roller 16 are rotatably mounted.

Initially, a portion of belt 110 passes through charging station A, where a corona device 122 charges a portion of belt 110 to a relatively high, substantially uniform, potential, either positive or negative.

At exposure station B, flash lamps 132 illuminate an original document on transparent platen 30. Lens 133 projects light rays reflected from the original document onto the charged portion of belt 110 to selectively dissipate the charge on belt 110. This selective discharging records an electrostatic latent image, corresponding to an image on the original document, on belt 110. Alternatively, a laser may be provided to selectively discharge belt 110 in accordance with stored electronic information.

Belt 110 then advances the electrostatic latent image to development station C. Development station C includes two developer housings 134 and 136 for contacting belt 110 to develop the electrostatic latent image. Cams 138 and 140 move housings 134 and 136 into and out of a developing position. Motor 121 selectively drives cams 138 and 140. Each developer housing 134 and 136 supports a developing system including brush rolls 142 and 144, each of which includes a rotating magnetic member for advancing developer mix, carrier beads and toner, into contact with the electrostatic latent image. The electrostatic latent image attracts toner particles from the carrier beads to form a toner powder image on belt 110. If only one color of developer material is required, the second developer housing may be omitted.

A sheet of paper 149 advances from supply tray 50 to transfer station D along conveyor 156. Belt 110 advances the toner powder image to transfer station D, where the sheet of paper contacts the powder image on belt 110. A corona generator 146 charges the paper to a potential such that the paper becomes tacked to belt 110 and the toner powder image is attracted from belt 110 to the paper. A corona generator 148 then charges the paper such that the paper becomes detached from belt 110, allowing stripping roller 114 to remove the paper from belt 110.

Subsequently, the paper moves in the direction of arrow 60 to fusing station E. Fusing station E includes a fuser assembly 170 that permanently affixes the transferred toner powder image to the paper. Fuser assembly 170 includes a heated fuser roller 172 and a backup roller 174 for pressure engaging the toner powder image, which contacts fuser roller 172. The paper then advances through a chute 162 to paper output tray 180.

Figure 3:
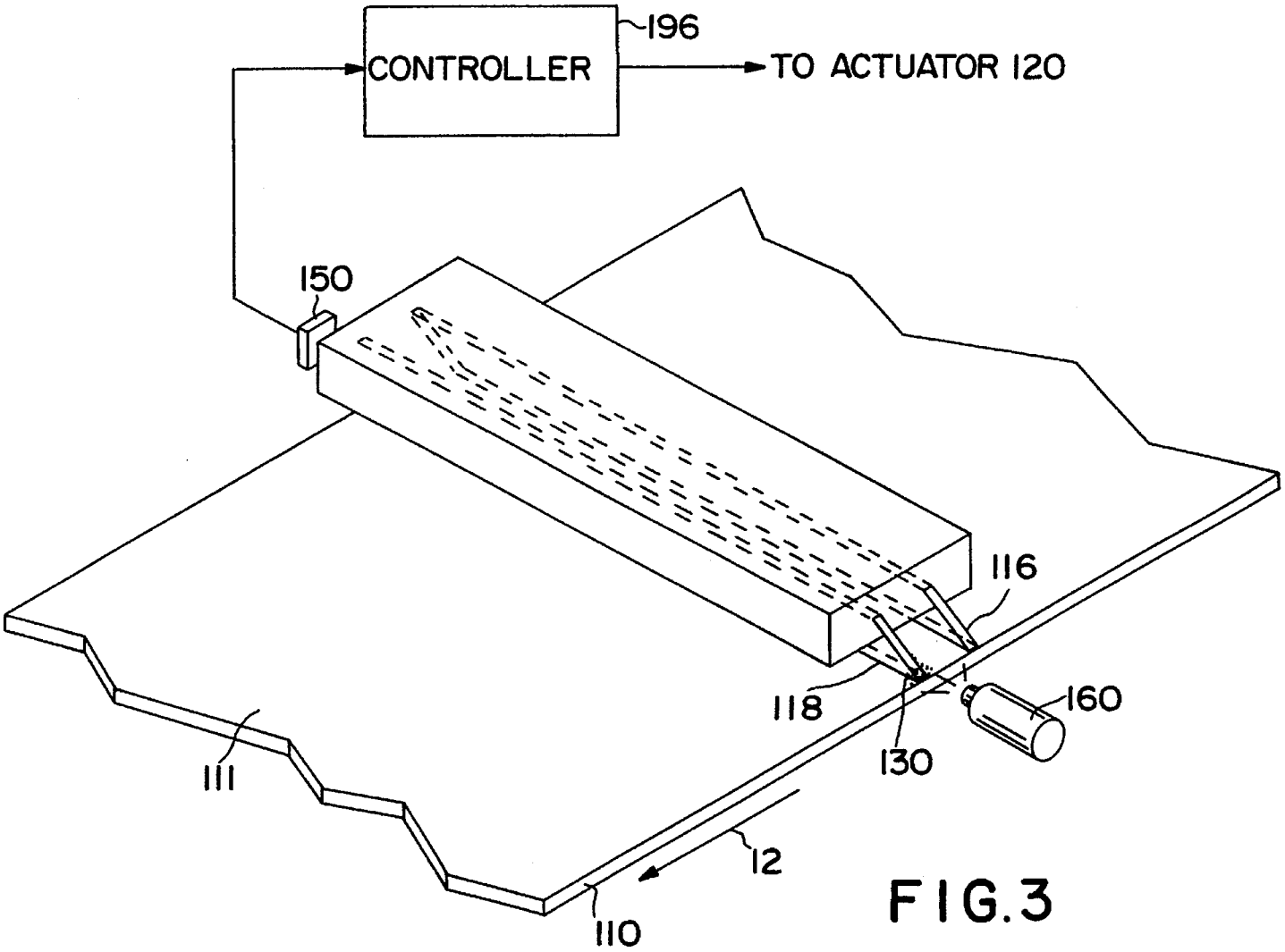
FIG. 3 is a partially schematic, fragmentary perspective view showing a portion of the operating components shown in FIG. 2 in more detail, in accordance with a first embodiment of the present invention.

Cleaning station F removes residual particles remaining on photoreceptor belt 110 after each copy is made. FIG. 3 shows cleaning station F in more detail. A primary cleaning blade 116 is located upstream in the process direction from a secondary cleaning blade 118. Primary blade 116 removes most of the residual particles from the surface of belt 110. A vacuum system transports particles, removed by primary blade 116, to a waste particle receptacle. Alternatively, the particles may be transported by an auger in front of blade 116, or, if the cleaning station is located under the belt, the particles may be transported by gravity.

Secondary blade 118 accumulates particles not removed by primary blade 116. Secondary blade 118 accumulates particles in a location that blocks an optical path between light source 160 and photodetector 150, which sends a signal to controller 196 to control actuator 120 to vary an amount of pressure applied to primary blade 116, as discussed in more detail below.

Figure 4:
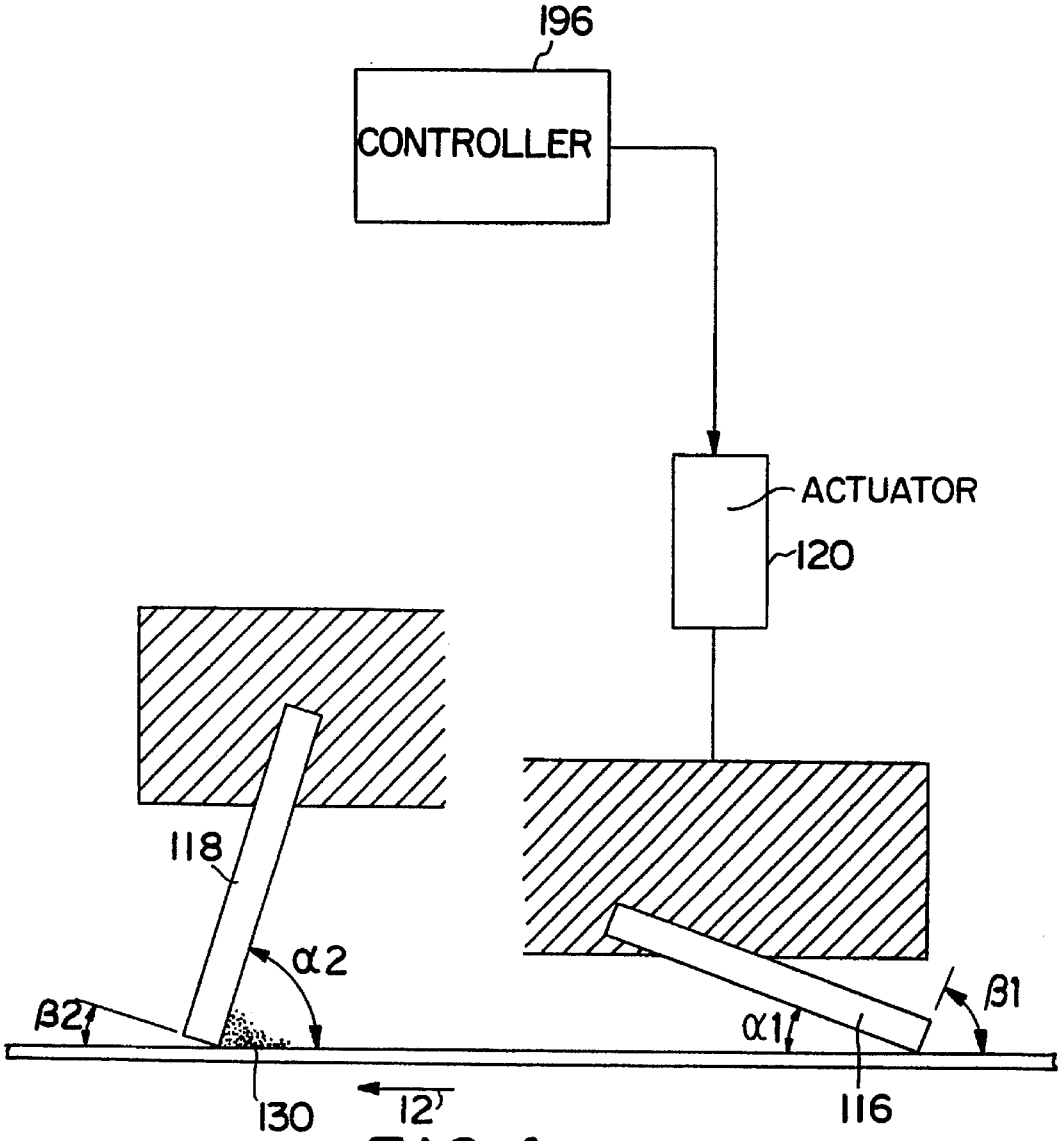
FIG. 4 is a cross-sectional diagram showing a portion of the operating components shown in FIG. 2 in more detail, in accordance with the first embodiment of the present invention.

FIG. 4 shows a cross-section of cleaning blades 116 and 118, each having an edge in frictional contact with the photoreceptor surface 111 at an angle $\alpha$ (where $\alpha$=180° ($\beta$+90° ). Primary blade 116 is configured in the "doctoring mode," having an angle $\alpha 1$ of approximately 10° to 25° with a preferred angle of approximately 15° when the pressure on primary blade 116 is approximately 35 grams/cm.

Secondary blade 118 is configured in the "wiping mode," having an angle $\alpha 2$ of approximately 65° to 80° with a preferred angle $\alpha 2$ of approximately 75° when the pressure on secondary blade 118 is approximately 35 grams/cm. In general, the secondary blade pressure for a given angle $\alpha$ will be less than that of the primary blade loading, because toner securely fixed on belt 110 acts as a lubricant and a secondary blade will see less of this securely fixed toner than the primary blade sees.

Secondary blade 118 accumulates residual particles 130 as copier 100 operates over a period of time. Copier 100 clears accumulated toner 130 by periodically blowing compressed air, by swabbing with a piece of plastic foam or other material, or, when copier 100 is not generating copy output, by momentarily camming secondary blade 118 away from belt 110, allowing the accumulated particles to be carried by belt 100 to the upstream primary blade 116.

A photodetector 150 and light source 160 oppose each other upstream from the cleaning edge of secondary cleaning blade 118. Accumulation of toner 130 blocks the passage of light between light source 160 and photodetector 150.

In general, an excessively large amount of toner getting past primary blade 116 indicates that primary blade 116 should apply additional pressure to belt 110. The rate of toner pile growth 130 is an increasing function of the rate of toner getting past primary blade 116. The amount of light detected by detector 150 is a decreasing function of the size of toner pile 130. Thus, if the amount of light received by detector 150 is below a certain threshold, a certain amount of time after cleaning blade 118 has been cleared of toner, controller 196 causes actuator 120 to apply a greater amount of pressure to primary blade 116, resulting in primary blade 116's applying a greater amount of pressure to belt 110.

It is desirable to always have some small level of residual toner passing under primary blade 116 to provide lubrication. Thus, an excessively small amount of toner getting past primary blade 116 indicates that primary blade 116 can, or should, apply less pressure to belt 110. If the amount of light detected by detector 150 is above a certain threshold, a certain amount of time after cleaning blade 118 has been cleared of toner, controller 196 causes actuator 120 to apply a lesser amount of pressure to cleaning blade 116, resulting in cleaning blade 116's applying a lesser amount of pressure to belt 110. Thus, controller 196 controls actuator 120 to apply pressure as an increasing function of detected toner.

In the first preferred copier, controller 196 causes actuator 120 to adjust the pressure on blade 116 no more often than every few hours, since the particle detection feedback loop operates relatively slowly, as blade 118 normally accumulates toner relatively slowly.

Figure 5:
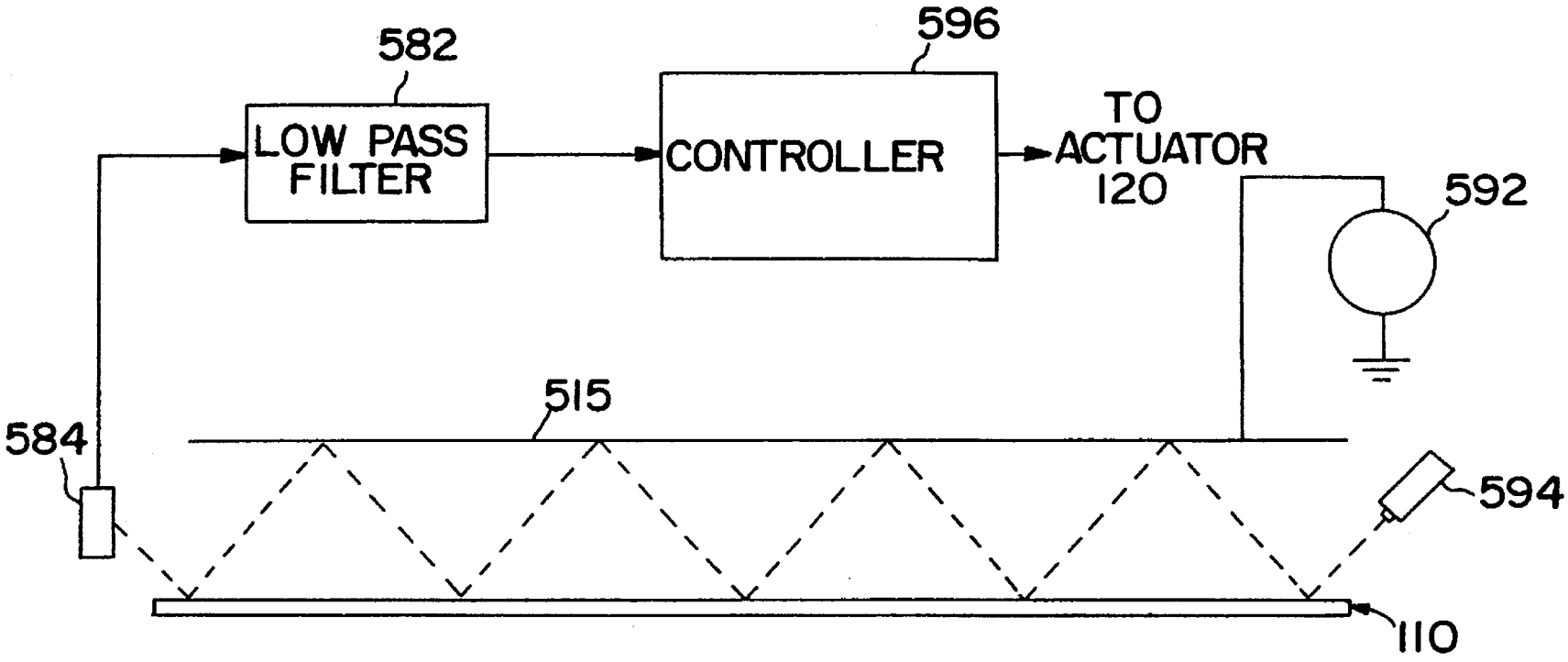
FIG. 5 is a cross-section of some of the operating components shown in FIG. 2 in more detail, in accordance with a second embodiment of the present invention.

The second embodiment of the present invention differs from the first preferred embodiment in the manner in which the amount of residual particles on belt 110 is detected. FIG. 5 shows the toner detection system of the second preferred copier. Laser 594 directs a light beam towards belt 110. If the light beam impinges on belt 110 on an area containing no residual particles, the light beam will be reflected to mirror 515, which is positioned approximately one inch above belt 110. Mirror 515 then reflects the light beam back to belt 110. Thus, the light beam reflects off of belt 110 multiple times before reaching detector 584.

If the light beam impinges on an area of belt 110 containing one or more residual particles, the amount of light received by detector 584 decreases.

Detector 584 sends a signal to low pass filter 582, which generates a smoothed version of the signal from detector 584, and sends the smoothed signal to controller 596. Low pass filter 582 compensates for the rapid movement of toner particles, fixed on moving belt 110, relative to laser 594 and detector 584. Controller 596 causes actuator 120 to apply pressure to belt 110 as a decreasing function of the smoothed signal from low pass filter 582.

Thus, the toner detection method of the second embodiment does not rely on accumulation of toner by a blade downstream from the primary blade.

Laser 594 is angled such that the light beam will impinge onto belt 110 a certain amount of times. A higher angle of incidence results in more reflections off belt 110 and a greater sensitivity of the system, resulting from an increased probability that the light beam will impinge on an area of belt 110 containing a toner particle. If the angle of incidence of a light beam is too high, however, the light signal ultimately received by detector 584 will be decreased, resulting from increased absorption of belt 110 due to the increased angle of incidence and resulting from the increased number of reflections from belt 110 and mirror 515 before the light beam ultimately impinges on detector 584.

Mirror 515 should be separated from belt 110 by a sufficient distance so that mirror 515 is not overly susceptible to contamination by toner particles. Further, to reduce toner particle contamination, bias voltage generator 592 charges mirror 515 with the same polarity as the toner particles to repel the toner particles. Further, air streams sweep across mirror 515, detector 584, and laser 594 to keep mirror 515, detector 584, and laser 594 relatively free of particles.

Thus, the preferred embodiments of the present invention employ a method for determining an amount of loading of a cleaning blade to clean a photoreceptor and to increase the reliability and life expectancy of a blade cleaning system.

The preferred embodiments of the present invention may be modified in various ways. If the substrate is sufficiently translucent, rear illumination of part or all of the width of the substrate is advantageous, because detection of transmitted light is relatively insensitive to surface scratches. The photodetector could be located at a fixed position along the width of the substrate, could span the entire rear-illuminated width, or could be scanned back and forth along the width.

Figure 6:
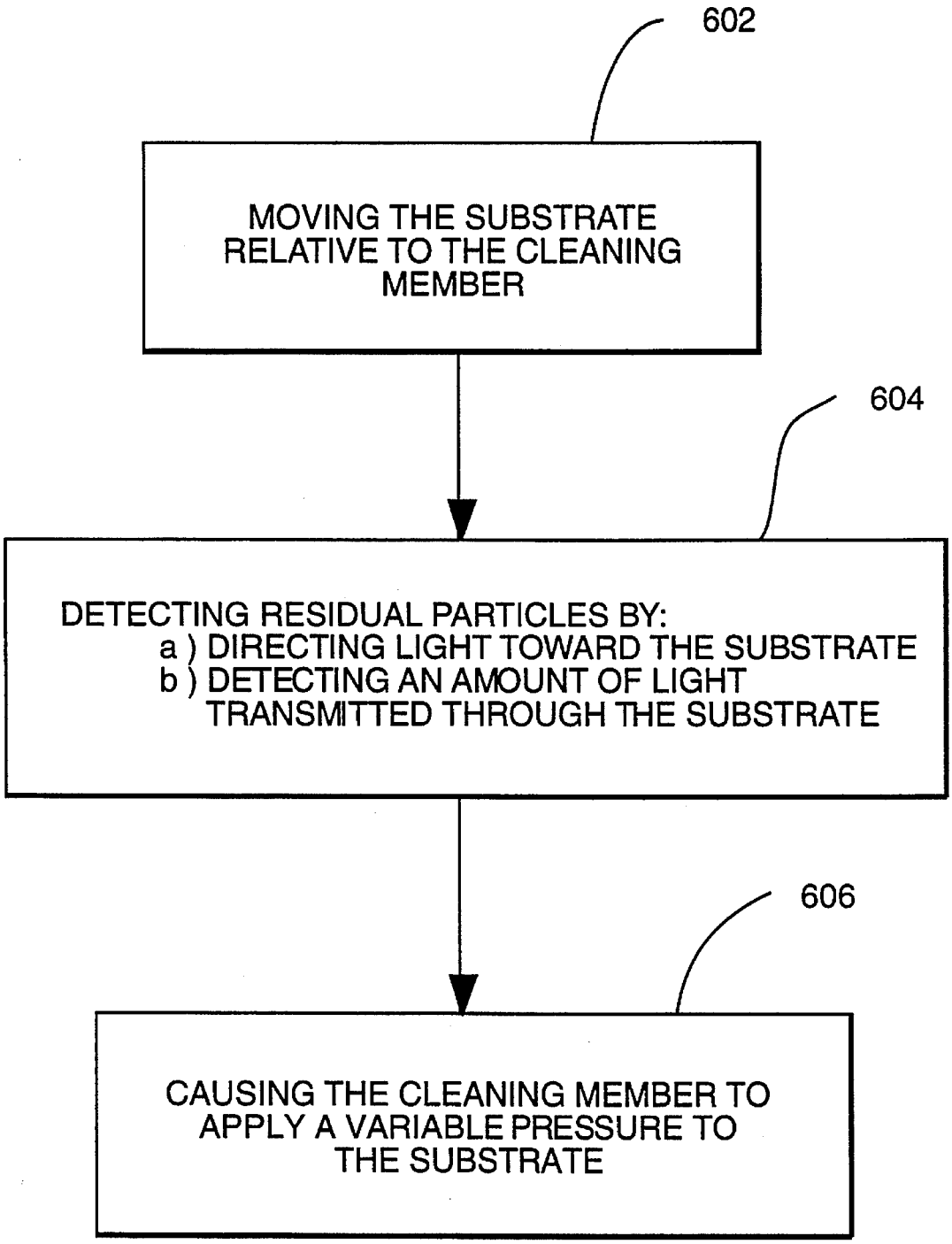
FIG. 6 is a flow chart illustrating a method in accordance with another embodiment of the invention.

FIG. 6 is a flow chart illustrating a method of operating an apparatus having a substrate and a cleaning member contacting the substrate in accordance with another embodiment of the invention. As illustrated this method includes step 602 of moving the substrate relative to the cleaning member, step 604 of detecting residual particles and step 606 of causing the cleaning member to apply a variable pressure to the substrate, wherein the variable pressure is an increasing function of an amount of residual particles detected by the detecting step 604. As shown in FIG. 6, the detecting step 604 further includes the steps of directing light toward the substrate and detecting an amount of light transmitted through the substrate. Additionally the detecting of step 604 may be at a location downstream from the cleaning member.

Detection of the residual toner densities upstream of the primary blade would allow the system to adjust blade pressure before the detected toner levels reach the primary blade.

Although a photoreceptor belt is shown, the proposed invention is applicable to drum type photoreceptors as well.

Additional advantages and modifications will readily occur to those skilled in the art. The invention in its broader aspects is therefore not limited to the specific details, representative apparatus, and illustrative examples shown and described. Thus, various modifications and variations can be made to the present invention without departing from the scope or spirit of the invention, and it is intended that the present invention cover the modifications and variations provided they come within the scope of the appended claims and their equivalents.

We claim:

1. A method of operating an apparatus having a substrate, a mirror positioned adjacent to the substrate and a cleaning member contacting the substrate, the method comprising the steps of:

moving the substrate relative to the cleaning member;

detecting residual particles on the substrate, the detecting step including the substeps of:

directing light toward the substrate, reflecting the light from the substrate toward the mirror, reflecting the light from the mirror toward the substrate after the substep of reflecting light from the substrate, and detecting an amount of light reflected from the substrate; and causing the cleaning member to apply a variable pressure to the substrate, the variable pressure being an increasing function of an amount of residual particles detected by the detecting step.

2. The method recited in claim 1, wherein the detecting step further comprises the substep of performing the substeps of reflecting light from the substrate and reflecting light from the mirror a plurality of times.

3. A method of operating an apparatus having a substrate, a mirror positioned adjacent to the substrate and a cleaning member contacting the substrate, the method comprising the steps of:

moving the substrate relative to the cleaning member;

detecting residual particles at a location downstream from the cleaning member, the detecting step including the substeps of:

directing light toward the substrate, reflecting the light from the substrate toward the mirror, reflecting the light from the mirror toward the substrate after the substep of reflecting light from the substrate, and detecting an amount of light reflected from the substrate; and causing the cleaning member to apply a variable pressure to the substrate, the variable pressure being an increasing function of an amount of residual particles detected by the detecting step.

4. The method recited in claim 3, wherein the detecting step further comprises the substep of performing the substeps of reflecting light from the substrate and reflecting light from the mirror a plurality of times.

5. A method of operating an apparatus having a substrate, a cleaning member contacting the substrate and a second member, located downstream from the cleaning member, for accumulating residual particles, the method comprising the steps of:

moving the substrate relative to the cleaning member;

detecting residual particles at a location downstream from the cleaning member, the detecting step including the substep of:

detecting an amount of residual particles accumulated by the second member within a certain period of time; and causing the cleaning member to apply a variable pressure to the substrate, the variable pressure being an increasing function of an amount of residual particles detected by the detecting step.

6. The method recited in claim 5, wherein the detecting step further comprises the substeps of:

directing light toward the substrate; and detecting an amount of light transmitted through the substrate.

7. A method of operating an apparatus having a substrate, a cleaning member contacting the substrate and a second member, located downstream from the cleaning member, for accumulating residual particles, the method comprising the steps of:

moving the substrate relative to the cleaning member;

detecting residual particles at a location downstream from the cleaning member, the detecting step including the substeps of:

directing light over the substrate, upstream from the second member, toward a target, and detecting an amount of light received by the target, to detect an amount of residual particles; and causing the cleaning member to apply a variable pressure to the substrate, the variable pressure being an increasing function of an amount of residual particles detected by the detecting step.

8. A method of operating an apparatus having a substrate and a cleaning member contacting the substrate, the method comprising the steps of:

moving the substrate relative to the cleaning member;

detecting residual particles on the substrate, the detecting step including the substeps of:

directing light across and above a surface of the substrate toward a target, so that an amount of residual particles on the substrate at least partially blocks the light, and detecting an amount of light received by the target, to detect the amount of residual particles; and causing the cleaning member to apply a variable pressure to the substrate, the variable pressure being an increasing function of an amount of residual particles detected by the detecting step.

9. An apparatus comprising:

a substrate;

a cleaning member configured to remove residual particles from the substrate;

means for moving the substrate relative to the cleaning member;

means for generating a signal indicating an amount of residual particles on the substrate, the generating means including:

a light source for directing light across and above a surface of the substrate toward a target, so that an amount of residual particles on the substrate at least partially blocks the light, a sensor for detecting the amount of light received by the target; and means, responsive to the signal, for causing the cleaning member to apply a variable pressure to the substrate.

10. An apparatus comprising:

a substrate;

a cleaning member configured to remove residual particles from the substrate;

means for moving the substrate relative to the cleaning member;

means for generating a signal indicating an amount of residual particles on the substrate, the generating means including:

a light source directed at the substrate, a mirror arranged adjacent the substrate to direct light reflected from the substrate back toward the substrate, and a sensor configured to detect an amount of light reflected from the substrate; and means, responsive to the signal, for causing the cleaning member to apply a variable pressure to the substrate.

11. The apparatus of claim 10, wherein the generating means further comprises:

means for detecting residual particles moving with the substrate.

12. The apparatus of claim 10, wherein the generating means generates a signal indicating the amount of residual particles at a location downstream from the cleaning member.

13. An apparatus comprising:

a substrate;

a cleaning member configured to remove residual particles from the substrate;

a second member, located downstream from the cleaning member, for accumulating residual particles;

means for moving the substrate relative to the cleaning member;

means for generating a signal indicating an amount of residual particles accumulated by the second member within a certain amount of time; and means, responsive to the signal, for causing the cleaning member to apply a variable pressure to the substrate.

14. The apparatus of claim 13, wherein the generating means further comprises:

a light source for directing light over the substrate, upstream of the second member, toward a target; and a sensor for detecting the amount of light received by the target, to detect an amount of residual particles.

* * * * *